US005098143A

United States Patent [19]

Hill

[11] Patent Number: 5,098,143

[45] Date of Patent: Mar. 24, 1992

[54] CABLE ATTACHMENT FOR BEAMS

[76] Inventor: Claud A. Hill, 2706 E. Contention Mine Rd., Phoenix, Ariz. 85032

[21] Appl. No.: 617,209

[22] Filed: Nov. 23, 1990

[51] Int. Cl.[5] ..... B66C 1/12

[52] U.S. Cl. ..... 294/74; 294/67.41

[58] Field of Search ..... 294/74, 82.11, 82.12, 294/82.13, 67.41, 103.1, 101; 206/453

[56] References Cited

U.S. PATENT DOCUMENTS 1,662,713 3/1928 Miller .
2,793,904 5/1957 Gale ..... 294/74
3,128,117 4/1964 Abolins ..... 294/67
3,718,361 2/1973 Marcotte ..... 294/67 E
3,743,341 7/1973 Gale ..... 294/74
4,066,287 1/1978 Rowley ..... 294/74

*Primary Examiner*—Margaret A. Focarino
*Assistant Examiner*—Dean Kramer
*Attorney, Agent, or Firm*—Warren F. B. Lindsley

[57] ABSTRACT

A device for preventing kinks in a cable extending around an edge of a load to be lifted by a hoisting mechanism comprising a U-shaped member for fitting over the edge of the load and having an arcuate outer surface for guiding the cable therearound and a pair of C-shaped flanges mounted on each end of said device for maintaining the cable on the arcuate surface.

4 Claims, 2 Drawing Sheets

CABLE ATTACHMENT FOR BEAMS

BACKGROUND OF THE INVENTION

This invention relates to sling assemblies for safely attaching to, raising and positioning in place long, heavy structural beams or other objects, by cranes or like equipment. More particularly, the invention relates to means for minimizing the bend of a cable passing over and around beams to minimize the sliding of the cable along the beam and to prevent any kinking of the cable.

DESCRIPTION OF THE PRIOR ART

Cable, wire rope, or rope arrangements using various hardware, are well known in the art, however, none of the known techniques, or combinations, employ a cable arrangement that includes a means of fastening around long objects without going around their ends and protects the cables from being sharply kinked, where passage over the relative sharp edges of beam flanges or sheet edges occurs.

U.S. Pat. No. 1,662,713 discloses an attachment for hoisting a sling which functions to insure the centering of the lift relative to the beam.

U.S. Pat. No. 2,793,904 discloses a sling arrangement for transporting large crates or containers from a central hoisting position or hook and more particularly to rope protector for protecting the rope from abrasion during the load lifting operation.

U.S. Pat. No. 3,128,117 discloses a method of directing the cable around the outside and bottom corners of containers to minimize the bend radii at these corners.

U.S. Pat. No. 3,718,361 discloses a platform or scaffolding for directing the ends of cables through longitudinal slots forming minimum bend channels.

U.S. Pat. No. 3,743,341 discloses a corner protector for articles to be lifted.

U.S. Pat. No. 4,066,287 discloses a protective shoe as a sling protector for minimizing sharp bends of a strap as it passes around sharp corners by using notched, bendable strap guides.

SUMMARY OF THE INVENTION

This invention relates to an improved sling assembly for lifting long beams and the like without undue kinking of the cable.

It is, therefore one object of this invention to provide a new and improved cable attachment for beams.

Another object of this invention is to provide a new and improved cable attachment for beams that provides a rounded bearing surface for the cable as it passes over the corners of the load.

A further object of this invention is to provide a wire rope cable softener that provides an arcuate surface for the cable passing over its corner flanges and forms a gripping surface for the load.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Referring more particularly to the drawings by characters of reference, FIGS. 1–7 disclose a combination wire rope, chain or cable assembly or device 10 affixed to a hook 11 attached to a crane, or any other device not shown but well known in the art for lifting, transporting and positioning in place heavy members such as I-beams and the like. This device sharply reduces kinks in the cable where bends occur and prevents the cable arrangement from slipping or sliding on the beams at points of lift.

Figure 1:
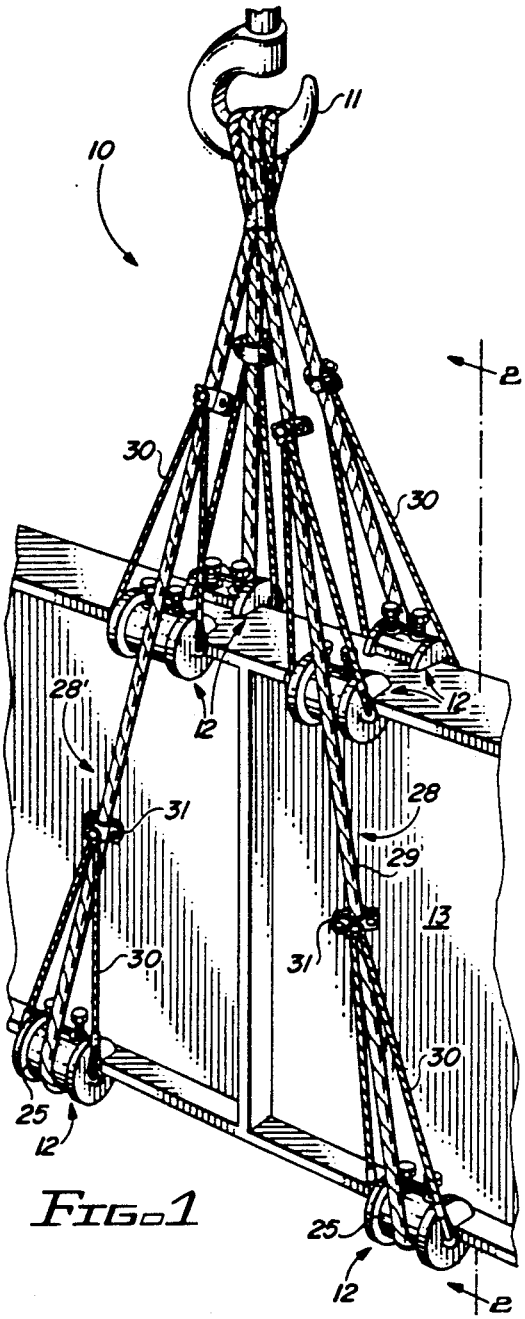
FIG. 1 is a perspective view of a cable harness arrangement wrapped around affixed anti kink spools attached to a portion of an I beam.
Figure 2:
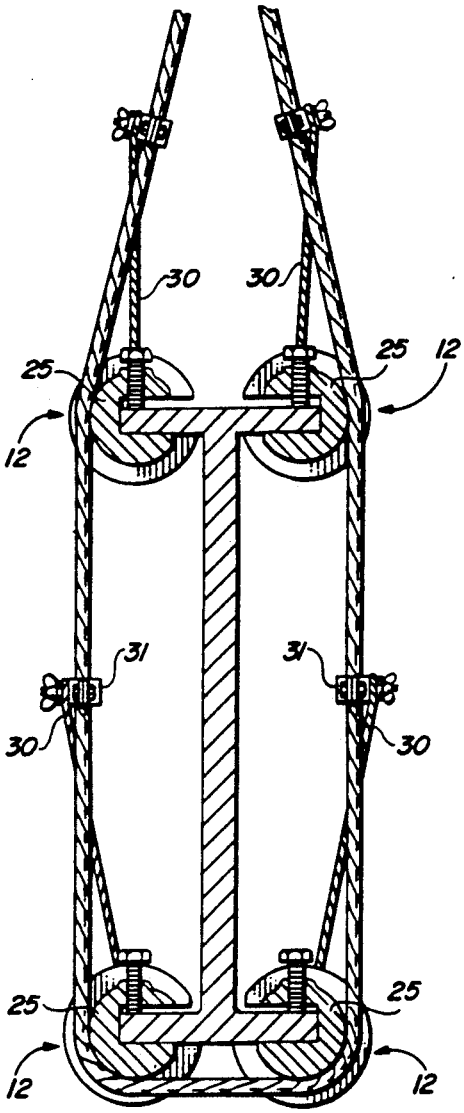
FIG. 2 is a cross sectional view of FIG. 1 taken along the line 2—2.

As shown in FIGS. 1 and 2, eight identical "anti kink/slide, cable spools," or sub assemblies 12 are spacedly positioned around an I-beam 13 for lifting and cable control purposes.

Figure 3:
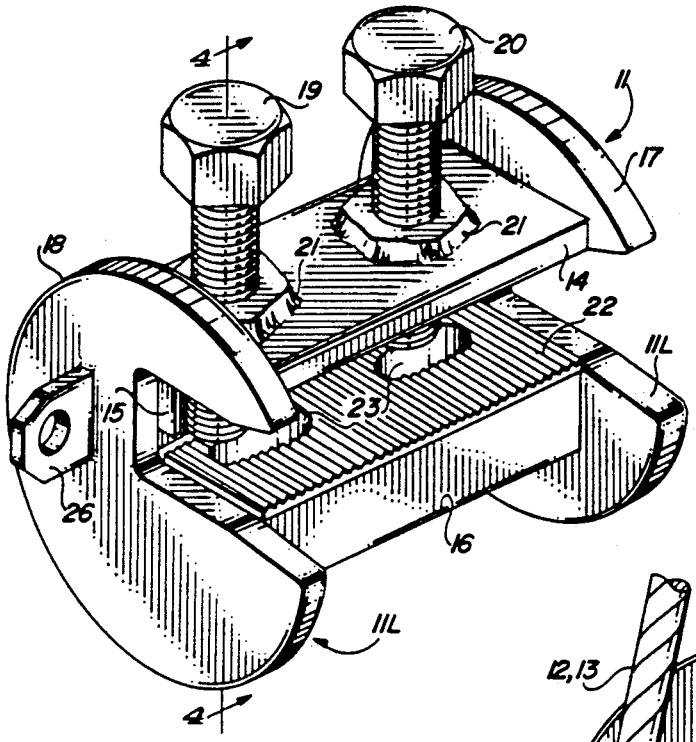
FIG. 3 is a perspective view of one spool of the cable harness.
Figure 4:
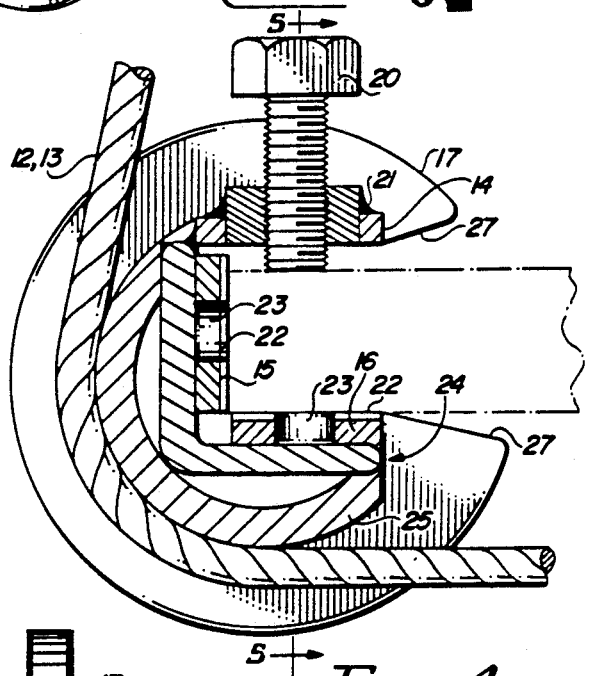
FIG. 4 is a cross sectional view of FIG. 3 taken along the line 4—4.
Figure 5:
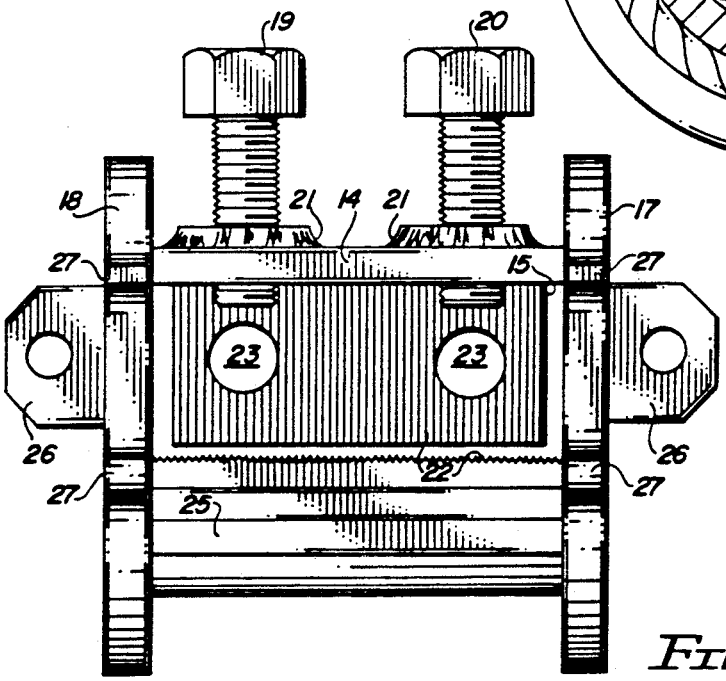
FIG. 5 is a cross sectional view of FIG. 4 taken along the line 5—5.

These sub assemblies 12 each comprise a cylindrical configuration forming a U-shaped gripping opening for grasping the flanges of a beam such as I-beam 13. As shown in FIGS. 3–5, each of these subassemblies comprise three plates 14, 15 and 16 welded to form a U-shaped configuration for receiving in the U-shaped opening a flange of the I-beam 13. At each end of the assembled plates are positioned and secured C-shaped flanges 17 and 18 which together form the sub assembly.

A pair of bolts 19 and 20 are used to clamp the sub assemblies to the flanges of I-beams 13 and are threadedly secured to plate 14 through nuts 21 which are secured by welding to plate 14 around threaded holes therein.

As noted one or more of the facing surfaces of plates 14 and 16 may be provided with a serrated surface 22 to provide an anti skid surface for the flanges of the I-beam gripped by device 10.

A pair of holes 23 are provided one in each of plates 15 and 16, respectively, to increase the hold on the surfaces to be clamped by providing a recession for any pressure build up.

A back up right angle piece 24 may be provided as a backstop for plates 15 and 16 and is welded to the inside edges of a C-shaped segment of tubing 25 which on its outside periphery provides an anti-kink, i.e., limitation of sharp bends when device 10 is fastened to an I-beam for lifting purposes.

As shown in FIGS. 3–5, C-shaped flanges 17 and 18 are secured to each end of C-shaped segment 25 with apertured sling connector brackets 26 extending laterally outwardly of each of flanges 17 and 18. As shown in FIG. 4, the edges of the C-shaped flanges 17 and 18 may be angled at 27 to aid in receiving the flanges of I-beam 13.

Although other methods of fabrication are known for manufacturing and assemblying device 10 the disclosed features should be adhered to.

With further reference to FIGS. 1 and 2, it should be noted that cable main slings 28 and 28' are divided into sub assemblies for right and left hand use. This was done to facilitate the explanation of the cable fastening sequence. As noted, cable 29 starts with a closed loop at its top fastened over hook 11 of the hoisting device and fastened with a compression sleeve in the usual manner and continuing downwardly where it extends over and partially around C-shaped segments 25 of devices 10 more clearly shown in FIG. 4.

The cable is then passed under the member to be lifted such as I-beam 13 continuing upwardly on the rear side of the beam after having passed over a C-shaped segment 25 of another device 10, as shown, continuing up the rear side of the load or beam for attachment to hook 11.

As the cable passes any protruding, relatively sharp corner of the protruding flanges of I-beam 13, for example, it will be confined into and around the curvature of the C-shaped segment 25 of the associated device 10.

Figure 6:
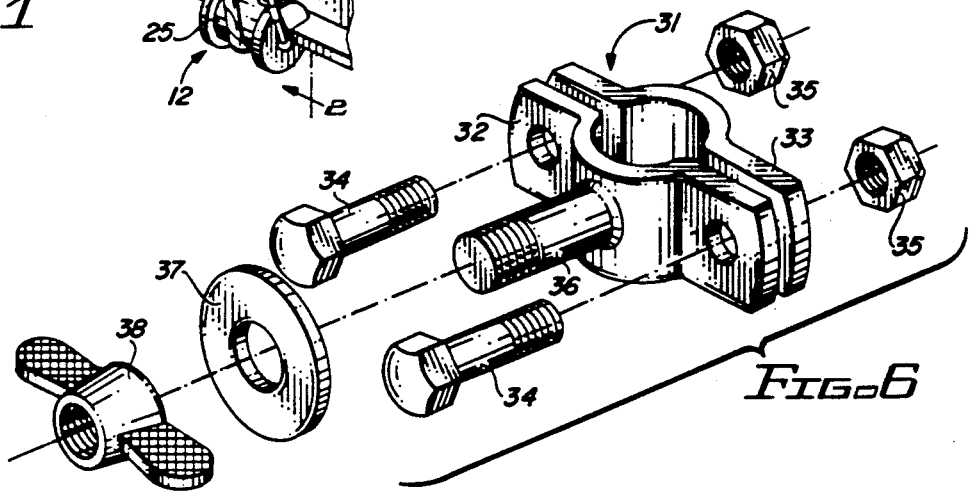
FIG. 6 is an enlarged, exploded view of the spool hanger assembly.

Approximately half way down the sling comprising cable 29, a secondary sling 30 is clamped to cable 29 one on each side of cable 29. This secondary sling is intended to secure sub assembly 12 to cable 29 thereby preventing cable 29 from falling away from the sub assembly 12. Secondary sling 30 is clamped to cable 29 by a clamp 31 which, as shown in FIG. 6, comprises two clamp sections 32 and 33, secured together by a pair of bolt and nut connections 34 and 35, respectively. A post 36 protrudes from clamp section 32 with a washer 37 and wing nut 38 used to secure the secondary sling 30 to cable 29, as shown.

This cable or clamp assembly 31 is used whenever a suspension of device 10 is needed. It aids in locating the sling position and particularly the location of devices 10 so that once positioned for lifting a first I-beam it can maintain the sling's position for the lifting of similar I-beams.

Figure 7:
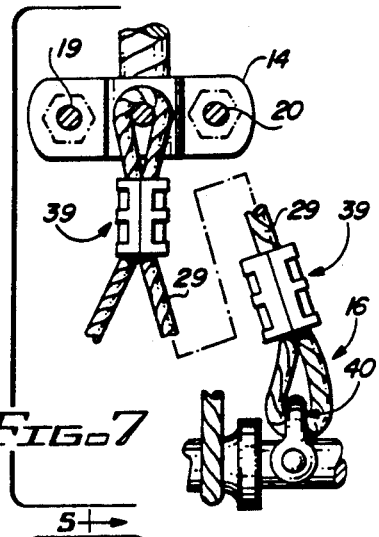
FIG. 7 is a partial breakaway view of a bridle sling and attachments therefor.

As shown in FIG. 7, at the two extremities of cable 29 forming a sling assembly, are affixed compression sleeves 39. Before closure, the end of cable 29, is passed through a device known as a shackle 40 which minimizes abrasion and allows a certain amount of swivel or cable turning freedom.

Although only one embodiment of the invention has been shown, it will be apparent to those skilled in the art that various changes and modifications may be made therein without departing from the spirit of the invention or from the scope of the appended claims.

What is claimed is:

1. A device for attaching to elongated flexible load lifting cables for grasping the edges of a weight to be lifted by an associated hoisting mechanism comprising:

a U-shaped elongated member for receiving an edge of a weight to be lifted and comprising means for securing said edge of the weight in said U-shaped member, an arcuate member mounted at least partially around the length of said U-shaped member and providing an outer arcuate surface for receiving a cable of an attached sling partially therearound, and a pair of C-shaped flanges one mounted to said U-shaped elongated member at each end thereof with the opening of each of said C-shaped flanges aligning with the opening of said U-shaped elongated member, said flanges forming a channel with said arcuate surface of said arcuate member to guide an associated cable extending over said arcuate surface and to maintain it thereon, said means for securing said edge of the weight comprising at least a pair of bolts extending through one side of said U-shaped elongated member and against an edge of the weight.

2. The device set forth in claim 1 wherein:

the opening of each of said C-shaped flanges has tapered edges for receiving the edge of said weight.

3. The device set forth in claim 1 in combination with:

a plurality of like devices, one of said devices being mounted on like flanges of an associated I-beam, and an associated lifting cable forming a sling extending from a hook of an associated hoisting mechanism at least partially around said arcuate surface of a number of like devices and back to said hook of said hoisting mechanism, whereby the cable when extending around an edge of the weight being lifted extends around an arcuate surface.

4. A device for attaching to elongated flexible load lifting cables for grasping the edges of a weight to be lifted by an associated hoisting mechanism comprising:

a U-shaped elongated member for receiving an edge of a weight to be lifted and comprising means for securing said edge of the weight in said U-shaped member, an arcuate member mounted at least partially around the length of said U-shaped member and providing an outer arcuate surface for receiving a cable of an attached sling partially therearound, and a pair of C-shaped flanges one mounted to said U-shaped elongated member at each end thereof with the opening of each of said C-shaped flanges aligning with the opening of said U-shaped elongated member, said flanges forming a channel with said arcuate surface of said arcuate member to guide an associated cable extending over said arcuate surface and to maintain it thereon, each of said C-shaped flanges having an apertured bracket extending laterally outwardly from said device for attaching to an associated lifting cable.

* * * * *